United States Patent [19]

Fachbach et al.

[11] 3,951,114

[45] Apr. 20, 1976

[54] COOLING OF INTERNAL COMBUSTION ENGINES WITH SOUND-PROOF ENCASINGS

[75] Inventors: Heinz Fachbach; Gerhard Thien; Karl Kirchweger, all of Graz, Austria

[73] Assignee: Hans List, Graz, Austria

[22] Filed: Sept. 19, 1974

[21] Appl. No.: 507,524

[30] Foreign Application Priority Data

Mar. 22, 1974 Austria ..... 2408/74

[52] U.S. Cl. ..... 123/41.7; 123/195 C; 123/198 E; 181/33 K

[51] Int. Cl.[2] ..... F01P 1/02

[58] Field of Search ..... 123/41.7, 41.63, 195 C, 123/198 E; 181/33 K

[56] References Cited

UNITED STATES PATENTS

| | | | |
|---|---|---|---|
| 2,384,088 | 9/1945 | Hagen | 123/41.65 |
| 3,155,082 | 11/1964 | Roorda et al. | 123/198 E |
| 3,684,053 | 8/1972 | Fachbach et al. | 123/198 E X |
| 3,693,602 | 9/1972 | Thien et al. | 123/195 C X |
| 3,712,280 | 1/1973 | Brille et al. | 181/33 K X |

FOREIGN PATENTS OR APPLICATIONS

| | | | |
|---|---|---|---|
| 2,043,280 | 4/1971 | Germany | 123/195 C |
| 473,340 | 10/1937 | United Kingdom | 123/41.7 |

*Primary Examiner*—Charles J. Myhre
*Assistant Examiner*—William C. Anderson
*Attorney, Agent, or Firm*—Watson, Cole, Grindle & Watson

[57] ABSTRACT

An internal combustion engine comprising a sound-proof encasing surrounding the outer surfaces of the engine in spaced relation thereto, with a cooling-air inlet and a cooling-air outlet, a blower arranged between these apertures within the encasing and actuated by means of the internal combustion engine, and an additional ventilating device for the ventilation of the encasing after the internal combustion engine has been stopped.

2 Claims, 3 Drawing Figures

COOLING OF INTERNAL COMBUSTION ENGINES WITH SOUND-PROOF ENCASINGS

Figure 1:
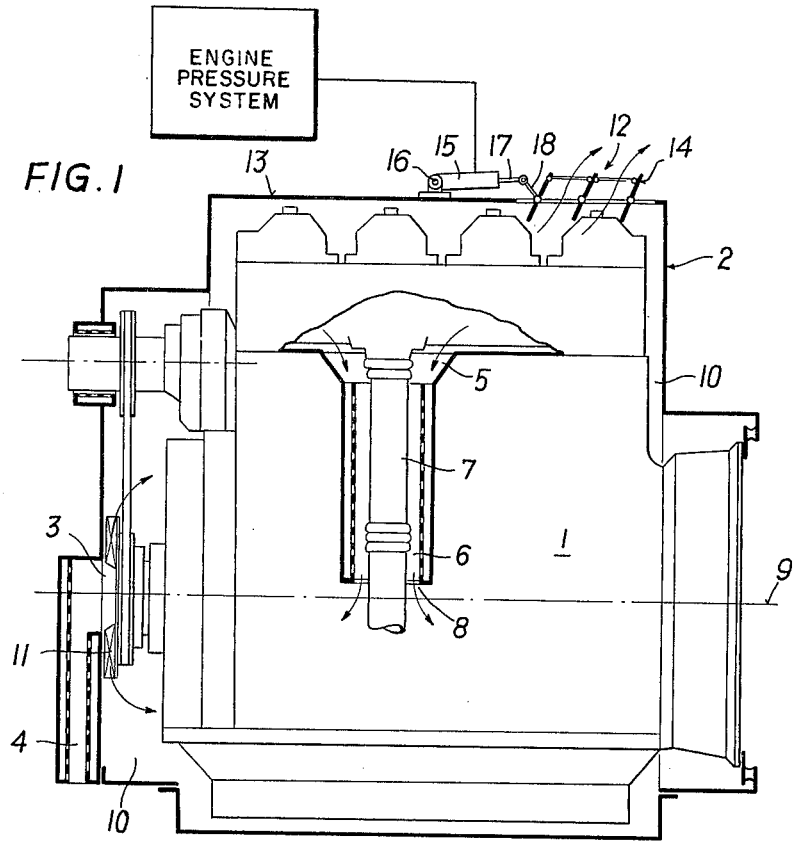

This invention relates to an internal combustion engine comprising a sound-proof encasing surrounding the outer surfaces of the engine and having at least one air inlet and one air outlet, and a blower located between the apertures of the encasing for the purpose of ventilating the space between the encasing and the outer surfaces of the engine.

Where engines are provided with sound-proof facings it is necessary to adequately ventilate the space between the casing and the engine so as to ensure evacuation of heat from the surfaces of the engine to the outside and above all to preclude any overheating of the casing and of its sealing elements and flexible suspensions.

The Austrian Pat. No. 298,164 discloses an air-cooled internal combustion engine wherein the cooling-air delivered by the blower included in the encasing first flows along the crankcase walls and is then directed from a distributing chamber in separate cooling-air ducts to the cylinders and to the valve cover chamber. By means of the appropriate design and the choice of cross-sectional dimensions of the various cooling-air ducts it is possible to adapt the cooling of the engine to local requirements and to prevent heat from accumulating within the casing during the operation of the engine.

It has been further disclosed by the Austrian Pat. No. 301,957 that in connection with a water-cooled engine with a sound-proof encasing a blower actuated by means of the crankshaft via a vee-belt is provided, drawing in cooling air through a cooling-air inlet sound-absorber located at the flywheel end of the engine and evacuating same after sweeping over the engine surfaces through a cooling air outlet sound-absorber surrounding the exhaust pipe in spaced relation to same. This is to prevent such parts of the encasing as are located in the vicinity of the encasing from being overheated.

By these known methods it is possible to meet essentially all the cooling requirements occurring during the operation of the engine. The position is, however, different during the interval immediately following the stoppage of an engine if same heats the environment by convection and above all, by radiation, mainly in the area of the particularly hot parts of the exhaust system or other engine zones subject to a particularly high thermal stress. This causes at least in these areas an accumulation of heat liable to cause damage to the casing or its sealing and supporting elements.

It is the purpose of the present invention to provide an internal combustion engine with sound-proof encasing of the type hereabove described, wherein local overheating of the encasing due to heat accumulation after the stoppage of the engine is positively avoided. According to the invention, at least that part of the space which is located in the area of engines zones subject to high thermal stress continues to be ventilated by means of a ventilating appliance which can be automatically started or allowed to continue to run when the engine is stopped. Thus the abduction of excessive engine heat is continued also during the time when the engine is allowed to cool off until such time when the temperatures even in the hottest place of the engine walls have dropped to a level which is tolerable for the encasing and its accessories.

In view of the presence of pressure-responsive systems, such as the lubricating-oil system or the vacuum-responsive suction line, as well as of the electrical appliances, such as the ignition or the dynamo circuit, anybody skilled in the art has quite a variety of different facilities for actuating the ventilating device, particularly in internal combustion engines, at his command. Likewise, it is possible to provide for the automatic stoppage of the ventilating device upon the expiration of a predetermined period of time to be fixed by trial and error, for example, or if and when the temperature of the engine has dropped to a predetermined level as indicated by the cooling-water thermostat for example. Thermostatic switch-off of the ventilating device appears to be particularly advisable for automotive engines which are subject to continuously changing stresses and climatic conditions in operation.

According to a particularly simple embodiment of the invention, the ventilating device is formed by at least one flap or the like attached to the top of the encasing with a means for opening same. When the flap is opened, a chimney effect is produced allowing the heated air to escape in an upward direction and cooled air to follow both through the cooling-air inlet shaft and through the cooling-air outlet shaft located opposite the flap at a lower level. Care should be used to design the flap in such a manner that it will provide a sound-proof closure when the engine is running so as not to impair the acoustic effect of the casing.

According to a further embodiment of the invention large cross-sectional areas for the discharge of the heated air can be advantageously obtained by designing the ventilating device as a louver comprising two or more drivingly interconnected flaps. As different from this design slides or similar closing members might be provided for the opening of this additional air outlet in lieu of flaps.

There is a large variety of means for the actuation of the flaps. According to one design which distinguishes itself by its simplicity and operational dependability, the flap or flaps is/are operated by means of an hydraulic or pneumatic working cylinder preferably connected to a pressure source of th engine. For example, it is possible to impinge upon the piston of the working cylinder with oil from the lubricating oil system of the engine in such a manner that the flaps are closed in the presence of normal lubricating oil pressure and opened again as the pressure drops as a result of stopping the internal combustion engine.

According to a further embodiment of the invention the ventilating device is formed by an electrically driven blower to be switched on for a predetermined period of time when the engine has been stopped. This blower maintains a definite amount of air flow also during the cooling period of the engine and if required, it may furthermore be used as a supplemental blower in addition to the cooling-air blower directly operated by the engine if and when the engine is running at full load for any considerable length of time.

Where an internal combustion engine is equipped with a turbosupercharger located within the encasing, substantial heat accumulation is liable to occur in view of the high temperatures of large surface areas not only during the cooling stage but also during the normal operation of the engine, particularly in such cases when the exhaust pipe and the cooling-air outlet sound-absorber are located in the lower area for considerations of space-saving. In such an event the cooling-air heated in the area of the turbosupercharger risks to sweep over cooler engine elements thereby heating same or at least obstructing the removal of heat from them. In order to meet these difficulties, according to another feature of the invention, the ventilating device is formed by an additional cooling-air outlet shaft located above the turbosupercharger and comprising a sound-absorber. This design also takes advantage of the chimney effect hereabove described for the improved aeration of the encasing and for more efficient cooling of the turbosupercharger. At the same time, the highly advantageous design of the main air outlet shaft as an absorption-type sound-absorber surrounding the exhaust pipe can be preserved unaltered.

Figure 2:
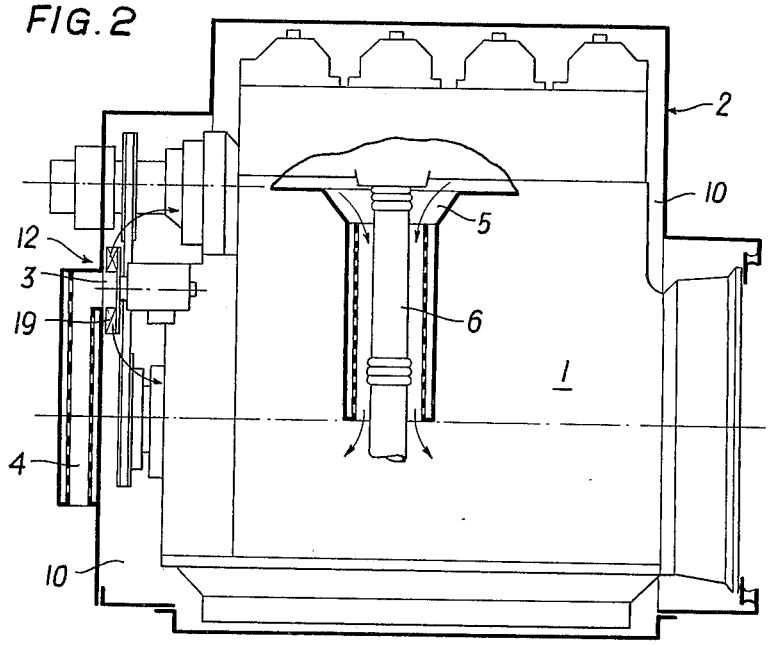
Figure 3:
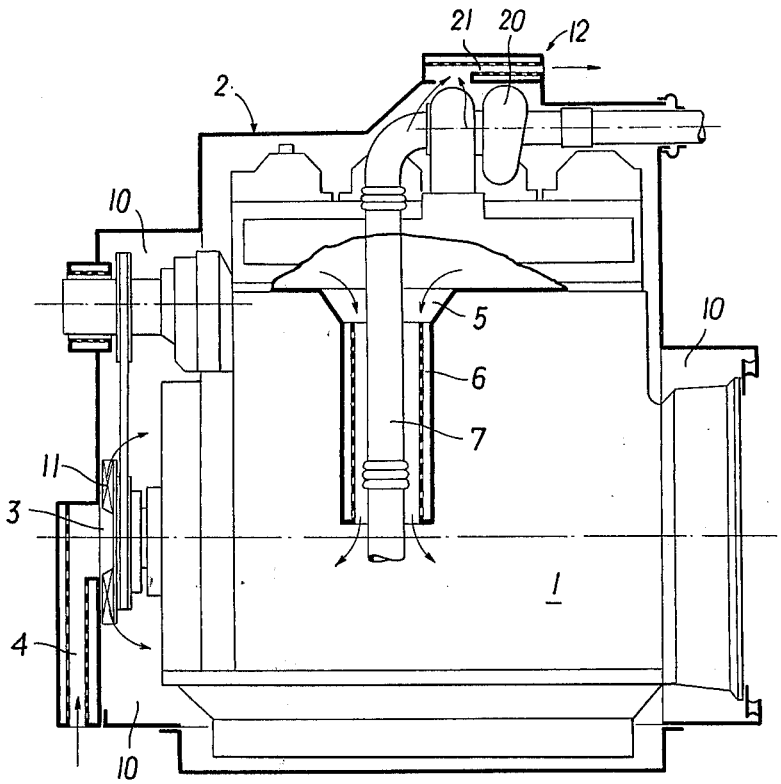

Further details of the invention will become apparent from the following description of several embodiments of the invention with reference to the accompanying drawing in which FIG. 1 is a lateral view of an internal combustion engine according to the invention wherein the essential elements of the sound-proof encasing are shown in a sectional view, FIG. 2 shows another variant of an internal combustion engine with a sound-proof encasing according to the invention illustrated as above, and FIG. 3 is yet another, partially sectional, lateral view of an internal combustion engine according to the invention equipped with a turbosupercharger. Identical elements of these three engine constructions are indicated by the same reference numbers.

FIG. 1 shows a water-cooled four-cylinder in-line internal combustion engine 1 with a sound-proof encasing 2 surrounding the external surfaces of the engine in spaced relation thereto. As is customary for similar engines having a sound-proof encasing, the encasing 2 presents a cooling-air inlet 3 preceded by an absorption-type sound-absorber 4 and a cooling-air outlet 5 likewise adjoined by an absorption-type sound-absorber 6. The latter is designed in a manner known per se as a cylindrical sleeve surrounding the exhaust pipe 7 of the engine in spaced relation thereto. In view of the fact that as usual, the exhaust pipe 7 extends in a downward direction alongside one of the sidewalls of the engine, the mouth 8 of the sound-absorber 6 is located in a comparatively low place of the engine 1, in the present instance just above the crankshaft axis 9.

For the ventilation of the space 10 between the encasing 2 and the outer surfaces of the engine 1, a blower 11 provided directly at the end of the crankshaft draws the cooling-air in through the sound-absorber 4 as indicated by the arrows in the drawing, and causes it to flow through the space 10 alongside the crankcase walls towards the top of the engine 1, from where the heated cooling-air flows downwards through the absorption-type sound-absorber 6 to escape into the open air.

The arrangement hereabove described gives satisfactory results as long as the engine is in operation and the blower 11 takes care of the permanent ventilation of the space 10 for the purpose of evacuating the heat radiated by the engine. As soon as the engine is stopped, however, air circulation within the encasing 2 ceases so that heat is accumulated at least in the area of such points of the engine surface as are subject to high thermal stress liable to damage or destroy elements of the encasing 2. To avoid this drawback, the internal combustion engine according to the invention is provided with a special ventilating device 12 which according to the embodiment of the invention shown in FIG. 1 consists of a louver comprising three drivingly interconnected flaps 14 and attached to the upper boundary wall 13 of the encasing 2. The flaps 14 shown in their opening position in the drawing are so designed that in their closing position which they occupy while the engine is in operation, they provide a sound-proof closing of the encasing 2 so as not to impair the acoustical effect of the encasing. The flaps 14 are actuated by means of an hydraulic or pneumatic working cylinder 15 which is attached with one of its upper extremities to the upper boundary wall 13 in such a way as to be orientable about the axis 16. The piston rod 17 of this working cylinder is in turn, hinged to the driving arm 18 of the louver formed by the flaps.

The ventilating device 12 is controlled automatically in such a manner that the flaps 14 closed during the operation of the internal combustion engine are opened when the engine is stopped. For that purpose, it is possible, for example, to have the working cylinder 15 impinged upon by means of oil from the lubricating oil system of the engine 1. As long as operational lubricating oil pressure is available, the piston rod 17 remains in its outermost end position in which it provides a sound-proof closing for the flaps 14. The space 10 between the encasing 2 and the outer surfaces of th engine is ventilated by means of the blower 11 as hereabove described. When the engine is stopped, pressure in the lubricating oil system drops so that the piston rod 17, loaded by means of a spring for example, assumes the position shown in FIG. 1 where the flaps 14 are opened. By the exposure of an additional air outlet on the upper side of the encasing 2 a chimney effect is produced as a result of which cool air enters the encasing 2 not only through the inlet sound-absorber 4 but also through the outlet sound-absorber 6 through which the flow passes normally in a downward direction, and emerges from said encasing after sweeping over the outer surfaces of the engine, at the same time evacuating the excess heat through the flaps 14. This assures adequate ventilation of the space 10 also during the cooling period of the engine.

As different from the above design, it would also be possible to use the underpressure in the suction piping of the engine 1 or any other operational characteristics of the engine for the automatic control of the flaps 14. In particular, the electrical operation of the flaps 14, such as by means of an electromagnet connected in the ignition or dynamo circuit would be feasible.

Where the internal combustion engine 1 is designed as illustrated in FIG. 2, the special ventilating device 12 is a electrically operated additional blower 19 to be switched on automatically after the engine has been stopped for a certain period of time. Thereby the circulation of air in the space 10 which is caused by means of a mechanically driven blower while the engine is in operation, as shown in FIG. 1, is maintained also during the cooling period of the engine. With this design too, the electrical additional blower 19 is switched on automatically by means of any operational characteristics of the internal combustion engine. The additional blower 19 can be switched off either upon the expiration of a predetermined period of time or as soon as a predetermined admissible maximum temperature has been reached by the engine.

The internal combustion engine 1 equipped with a turbosupercharger 20 as illustrated in FIG. 3 represents a special case insofar as in the area of the turbosupercharger 20 extremely high temperatures prevail within the encasing 2, considerably augmenting the risk of overheating the encasing or its members in the event of the circulation of air in the space 10 being inadequate. In that case, the risk of heat accumulation in the vicinity of the turbosupercharger 20 frequently prevails also during the operation of the engine, particularly so if as illustrated in the drawing, the outlet sound-absorber 6 is located in a low position. In that case, the cooling-air which has been heated in the area of the turbosupercharger, thereafter risks being swept over cooler engine zones, thereby heating same or at least obstructing the emission of heat from same.

In order to preclude the risk of similar heat accumulations, an additional cooling-air outlet shaft 21 equipped with an absorption-type sound-absorber is provided according to the invention above the turbosupercharger 20, serving as an additional ventilating device. By means of this cooling-air outlet shaft 21 it is possible to prevent heat accumulation within the encasing 2 both during the operation and after the engine 1 has been stopped, by appropriately taking advantage of the chimney effect, while the acoustical and thermal advantages of the design of the exhaust pipe 7 emerging from the outlet sound-absorber 6 are fully preserved.

With the same advantageous effects the invention is also applicable to air-cooled internal combustion engines. In addition thereto, it is also possible in special cases, to combine two or more of the features hereabove explained consisting in the additional ventilation of the space between the encasing and the outer surface of the engine.

We claim:

1. In an internal combustion engine comprising a sound absorbing casing surrounding the outer surfaces of the engine in spaced relation thereto and having one cooling air inlet, one cooling air outlet provided in a top wall of the casing, a cooling air blower arranged within the casing between the cooling air inlet and the cooling air outlet and driven by the engine, in combination:

a series of drivingly interconnected flaps arranged on the top wall of the casing in the area of the cooling air outlet;

a pressure actuated working cylinder arranged on the top wall of the casing in the vicinity of the cooling air outlet and drivingly connected with said flaps;

said working cylinder being actuated by a pressure system of the engine, which is pressureless when the engine stops.

2. An internal combustion engine according to claim 1, wherein said working cylinder is a hydraulic cylinder connected to the oil-pressure lubricating system of the engine.

* * * * *